US009926750B2

(12) United States Patent
Ringgenberg

(10) Patent No.: US 9,926,750 B2
(45) Date of Patent: Mar. 27, 2018

(54) PRESSURE RESPONSIVE DOWNHOLE TOOL HAVING AN ADJUSTABLE SHEAR THREAD RETAINING MECHANISM AND RELATED METHODS

(71) Applicant: HALLIBURTON ENERGY SERVICES, INC., Houston, TX (US)

(72) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 200 days.

(21) Appl. No.: 14/767,789

(22) PCT Filed: Mar. 14, 2013

(86) PCT No.: PCT/US2013/031550
§ 371 (c)(1),
(2) Date: Aug. 13, 2015

(87) PCT Pub. No.: WO2014/142899
PCT Pub. Date: Sep. 18, 2014

(65) Prior Publication Data
US 2015/0376958 A1 Dec. 31, 2015

(51) Int. Cl.
*E21B 17/06* (2006.01)
*E21B 34/06* (2006.01)

(52) U.S. Cl.
CPC ..... *E21B 17/06* (2013.01); *E21B 34/063* (2013.01)

(58) Field of Classification Search
CPC ..... E21B 17/06; E21B 34/063
See application file for complete search history.

(56) References Cited

U.S. PATENT DOCUMENTS 3,727,948 A * 4/1973 Current ..... E21B 17/06 285/3
4,729,433 A 3/1988 Jacob
5,029,642 A * 7/1991 Crawford ..... E21B 31/113 166/178
7,690,697 B2 4/2010 Church
8,079,413 B2 * 12/2011 Frazier ..... E21B 33/134 165/133
2012/0279700 A1 11/2012 Frazier

OTHER PUBLICATIONS

International Search Authority, International Search Report and Written Opinion, dated Dec. 9, 2013, 14 Pages, Korean Intellectual Property Office.

* cited by examiner

*Primary Examiner* — James G Sayre
(74) *Attorney, Agent, or Firm* — Haynes and Boone, LLP

(57) ABSTRACT

A pressure responsive downhole tool comprises a threaded shearable retaining mechanism which performs the tension sleeve or shear pin function. The threaded shearable retaining mechanism comprises a pin and box thread that shears upon application of a predetermined pressure which may be adjusted based upon the amount of thread engagement. The pin thread may comprise indicators to indicate which thread engagement corresponds to what shear value. A keystone thread design may be utilized such that the thread would be retained along the threaded connection and not become lost in the well. Thus, the present invention allows for each pressure responsive tool to be custom tailored for a specific job.

20 Claims, 6 Drawing Sheets

PRESSURE RESPONSIVE DOWNHOLE TOOL HAVING AN ADJUSTABLE SHEAR THREAD RETAINING MECHANISM AND RELATED METHODS

CROSS REFERENCE TO RELATED APPLICATIONS

The present application is a U.S. National Stage patent application of International Patent Application No. PCT/US2013/031550, filed on 14 Mar. 2013, the benefit of which is claimed and the disclosure of which is incorporated herein by reference in its entirety.

FIELD OF THE INVENTION

The present invention relates generally to pressure responsive downhole tools and, more specifically, to a pressure responsive downhole tool (drill stem tester valve or safety joint, for example) having a retaining mechanism that comprises a shearable threaded connection, wherein the releasing function of the threaded connection may be adjusted as desired.

BACKGROUND

Conventional drill stem tester valves, safety valves and other service tools utilize tension sleeves or shear pins to initiate some function of the tool. With safety joints, for example, the tension sleeve or shear pins must be parted or sheared to allow further string manipulation which facilitates further operation and/or disconnection of the safety joint.

There are a number of disadvantages associated with such conventional designs. First, as wells get deeper and the workstrings heavier, it is becoming increasingly difficult to select a tension sleeve for each specific job. Generally, it is desirable to have a high value for the tension sleeve to avoid accidental operation. Some sizes of safety joints only have two choices for the tension sleeve, for example, 40,000 lbs. or 60,000 lbs. However, a long heavy workstring may not tolerate a very high value tension sleeve because the tensile rating of the workstring could be exceeded. Second, installing 60 or more shear pins in a shear set can be very time consuming, as is generally the case with conventional designs. Third, once sheared, the shear pins parts are dropped in the well which may render fishing operations more difficult.

Accordingly, there is a need in the art for a retaining mechanism for use with a pressure responsive downhole tool which alleviates and/or overcomes these prior art disadvantages, thus providing a safer, adjustable, and more reliable downhole tool.

DESCRIPTION OF ILLUSTRATIVE EMBODIMENTS

Figure 1A:
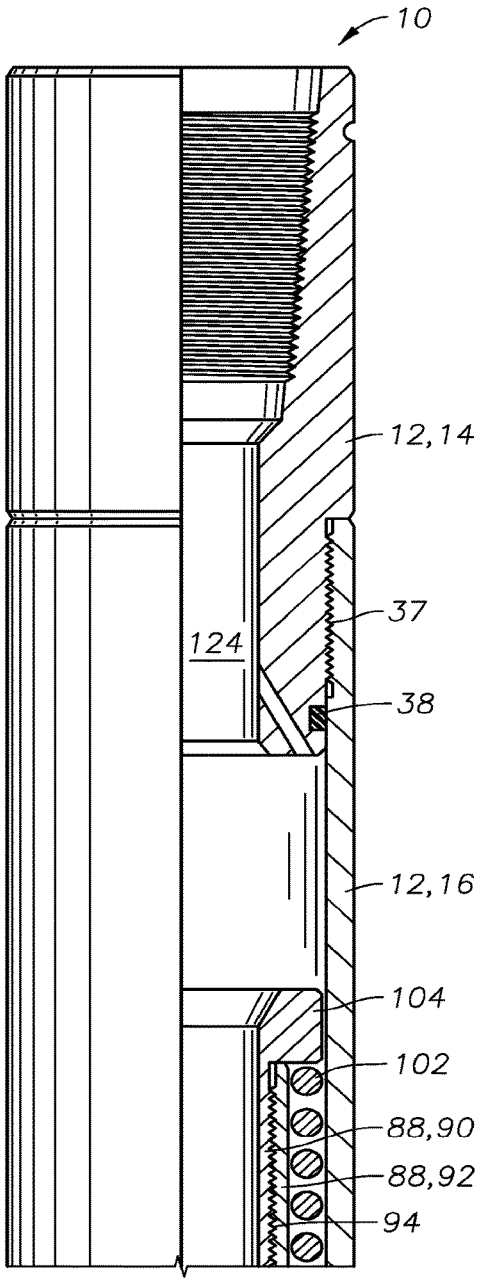
FIGS. 1A-1F are sectional views of a pressure responsive downhole tool (safety circulating valve) having a threaded shearable retaining mechanism in accordance to certain exemplary embodiments of the present invention.

Illustrative embodiments and related methodologies of the present invention are described below as they might be employed in a pressure responsive downhole tool having an adjustable shear thread retaining mechanism. In the interest of clarity, not all features of an actual implementation or methodology are described in this specification. Also, the "exemplary" embodiments described herein refer to examples of the present invention. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

As described herein, exemplary embodiments of the present invention are directed to a shearable threaded retaining mechanism for use with a variety of pressure responsive downhole tools, wherein the releasing function of the threads may be adjusted to shear at any desired pressure. The pressure responsive downhole tool may be a variety of tools, such as, for example, safety joints or tester valves (also referred to as safety valves). An exemplary tester valve may include, for example, the valve as described in U.S. Pat. No. 4,691,779, entitled "HYDROSTATIC REFERENCED SAFETY-CIRCULATING VALVE," issued on Sep. 8, 1987, while an exemplary safety joint may include, for example, the joint described in U.S. Pat. No. 4,484,633, entitled "SAFETY JOINT," issued on Nov. 27, 1984, both patents being owned by the Assignee of the present invention, Halliburton Energy Services, Co. of Houston, Tex., the disclosures of which are hereby incorporated by reference in their entirety. The inventive retaining mechanism described herein will be discussed in relation to those exemplary tester valves and safety joints. Therefore, not every feature and/or functionality of the tool itself will be discussed herein. Nevertheless, those ordinarily skilled in the art having the benefit of this disclosure realize the present invention may be applied to any variety of other pressure responsive tools.

As further described herein, exemplary embodiments of the pressure responsive tool include a threaded shearable retaining mechanism which performs the tension sleeve or shear pin function. The threaded shearable retaining mechanism comprises a pin and box thread. In certain exemplary embodiments, the pin thread has a constant pitch and is comprised of a weaker material than the box thread. The box thread comprises a variable pitch design such that all the engaged pin threads are equally loaded. The pressure at which the pin thread would shear (i.e., shear value) would be determined by the length, or degrees, of the pin thread that is engaged. By varying the length of the threaded engagement, the releasing function of the retaining mechanism is infinitely adjustable. In other embodiments, the pin thread comprises indicators on each thread to indicate what thread engagement corresponds to what shear value. In yet other embodiments, a keystone thread design is utilized such that the sheared pin thread would be retained along the box thread to avoid it becoming lost in the well. Moreover, in other embodiments, the box thread may be sheared instead of the pin thread, and/or the shear value indicators may be positioned along the box threads. Nevertheless, the present invention allows for each pressure responsive tool to be custom tailored for a specific job.

Referring now to FIGS. 1A-1F, an exemplary pressure responsive downhole tool 10 will now be described in accordance to one or more exemplary embodiments of the present invention. As previously described, pressure responsive downhole tool 10 may be, for example, a safety-circulating valve. For example, pressure responsive downhole tool 10 may be used with a formation testing string during the testing of an oil well to determine production capabilities of a subsurface formation. The testing string will be lowered into a well such that a well annulus is defined between the test string and the well bore hole. A packer (not shown) associated with pressure responsive downhole tool 10 will be set in the well bore to seal the well annulus below the pressure responsive downhole tool 10 as hereinafter described in detail, which is then subsequently operated by varying the pressure in the well annulus.

Referring now to the drawings, and particularly to FIGS. 1A-1F, a first exemplary embodiment of the pressure responsive downhole tool 10 includes a housing 12 comprised of an upper adapter 14, a spring housing section 16, a circulating valve housing section 18, a ball valve housing section 20, an upper power housing section 22, a shear thread housing section 24, a lower power housing section 26, a filler housing section 28, an equalizing chamber housing section 30 having inner and outer tubular members 32 and 34, and a lower adapter 36. Upper adapter 14 and spring housing section 16 are threadedly connected at 37 with a seal being provided therebetween by O-ring 38. The lower end of spring housing section 16 is connected to circulating valve housing section 18 at threaded connection 40 with a seal being provided therebetween by O-ring 42.

The circulating valve housing section 18 has its lower end connected to ball valve housing section 20 at threaded connection 44 with a seal being provided therebetween by O-ring 46. A lower end of ball valve housing section 20 is connected to upper power housing section 22 at threaded connection 48 with a seal being provided therebetween by O-ring 50. The lower end of upper power housing section 22 is connected to shear thread housing section 24 at threaded connection 52 with a seal being provided therebetween by O-ring 54. The shear thread housing section 24 has its lower end connected to lower power housing section 26 at threaded connection 56 with a seal being provided therebetween by O-ring 58. The lower end of lower power housing section 26 is connected to filler housing section 28 at threaded connection 60 with a seal being provided therebetween by O-ring 62.

Filler housing section 28 has its lower end connected to outer tubular member 34 of equalizing chamber housing section 30 at an outer threaded connection 64 with a seal being provided therebetween by O-ring 66. Filler housing section 28 also has its lower end connected to inner tubular member 32 of equalizing chamber housing section 30 at inner thread 68 with a seal being provided therebetween by O-ring 70. The lower end of outer tubular member 34 is connected to lower adapter 36 at threaded connection 72 with a seal being provided therebetween by O-ring 74. Inner tubular member 32 has its lower end 76 closely received within a bore 78 of lower adapter 36 with a seal being provided therebetween by O-ring 80.

Figure 1B:
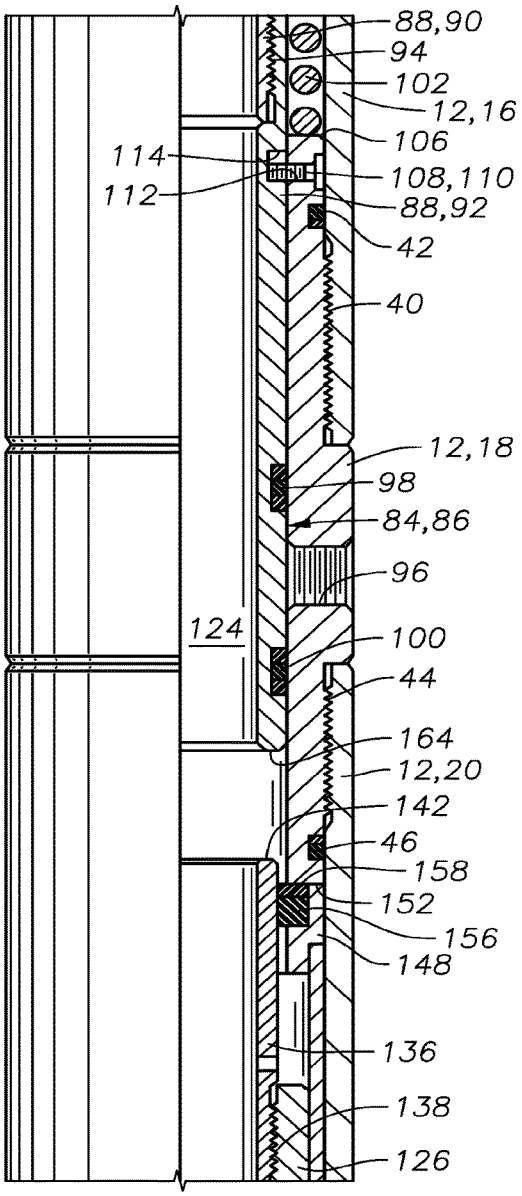
Figure 1C:
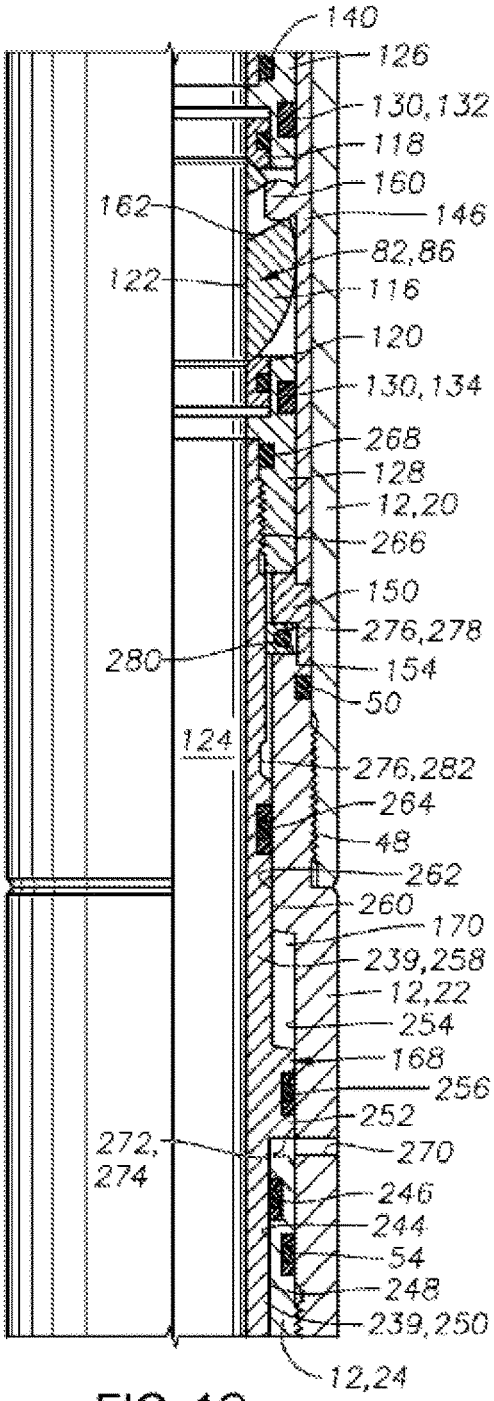

In this exemplary embodiment, pressure responsive downhole tool 10 includes a full open ball type safety valve mechanism, generally designated by the numeral 82, and a sliding sleeve type circulating valve mechanism generally designated by the numeral 84. The safety valve mechanism 82 and circulating valve mechanism 84 may be collectively referred to as an operating element mechanism 86. The operating element mechanism 86 is shown in FIGS. 1A-1C in what may generally be referred to as a first position of operating element mechanism 86. In this first position of operating element mechanism 86, safety valve mechanism 82 is in an open position and circulating valve mechanism 84 is in a closed position. As further described below, operating element mechanism 86 is movable to a second position relative to housing 12, wherein safety valve mechanism 82 is closed and the circulating valve mechanism 84 is open.

Circulating valve mechanism 84 includes a circulating valve sleeve 88 comprised of upper and lower portions 90 and 92 threadedly connected together at threaded connection 94. Circulating valve sleeve 88 is initially located in a closed position as shown in FIG. 1B, wherein lower portion 92 thereof blocks or closes a circulating port 96 disposed through circulating valve housing section 18 of housing 12. Lower portion 92 of circulating valve sleeve 88 has upper and lower longitudinally spaced annular seals 98 and 100 which are located on opposite sides of circulating port 96 when circulating valve mechanism 84 is in its closed position as shown in FIGS. 1A-1B. Circulating valve mechanism 84 also includes a coil compression spring biasing mechanism 102 which is initially compressed between a radially outward extending annular flange 104 of upper portion 90 and an upper end surface 106 of circulating valve housing section 18.

A releasable retaining mechanism 108 is provided for initially releasably retaining circulating valve sleeve 88 in its closed position. Releasable retaining mechanism 108 includes one or more shear pins 110 disposed through radial bores, such as 112, in circulating valve housing section 18 and received within an annular groove 114 of lower portion 92 of circulating valve sleeve 88.

Safety valve mechanism 82 includes a full opening ball valve 116 received between upper and lower annular seats 118 and 120. Ball valve 116 has a bore 122 which is initially aligned with and defines a portion of a longitudinally extending full opening flow passage 124 disposed through the pressure responsive downhole tool 10. Upper and lower seats 118 and 120 are received within bores of upper and lower seat holders 126 and 128, respectively. Upper and lower seat holders 126 and 128 are held in place relative to each other by a plurality of C-clamps, such as, for example, the C-clamp 130 which has its upper and lower ends 132 and 134 shown in FIG. 1C. An actuating mandrel 136 is connected to upper seat holder 126 at threaded connection 138 with a seal being provided therebetween by O-ring 140.

Still referring to the exemplary embodiment of FIGS. 1A-1F, safety valve mechanism 82 includes a pair of actuating arms, only one of which is shown and designated by the numeral 146. Actuating arm 146 is held in place longitudinally relative to ball valve housing section 20 by upper and lower annular inserts 148 and 150, which are longitudinally trapped between a lower end 152 of circulating valve housing section 18 and an upper end 154 of upper power housing section 22. A shock absorbing O-ring 156 and a spacer washer 158 are disposed between lower end 152 of circulating valve housing section 18 and upper insert 148.

Actuating arm 146 includes a radially inward extending actuating lug 160 received in an eccentric bore 162 of ball valve 116. As previously stated, this exemplary embodiment comprises two such actuating arms 146 circumferentially spaced about the ball valve 116, each of which includes a lug 160 engaging an eccentric bore 162, so that when ball valve member 116 is moved longitudinally upward from the position shown in FIG. 1C relative to housing 12, ball valve 116 will be rotated to a closed position wherein its bore 122 is oriented at a 90° angle to longitudinal flow passage 124 disposed through the pressure responsive downhole tool 10.

As will be further described in detail below, ball valve 116 will be rapidly pushed irreversibly upward relative to the housing 12 in response to an increase in well annulus pressure. When that occurs, actuating mandrel 136 will also move longitudinally upward relative to housing 12 and an upper end 142 of actuating mandrel 136 will impact a lower end 164 of lower portion 92 of circulating valve sleeve 88 to shear the shear pin 110 and allow circulating valve sleeve 88 to be irreversibly moved upward to an open position by expansion of coil compression spring 102, thus moving lower end 164 of lower portion 92 of circulating valve sleeve 88 upward to a position above circulating port 96, thus opening circulating port 96 to provide communication between flow passage 124 and the well annulus exterior of the housing 12.

Figure 1D:
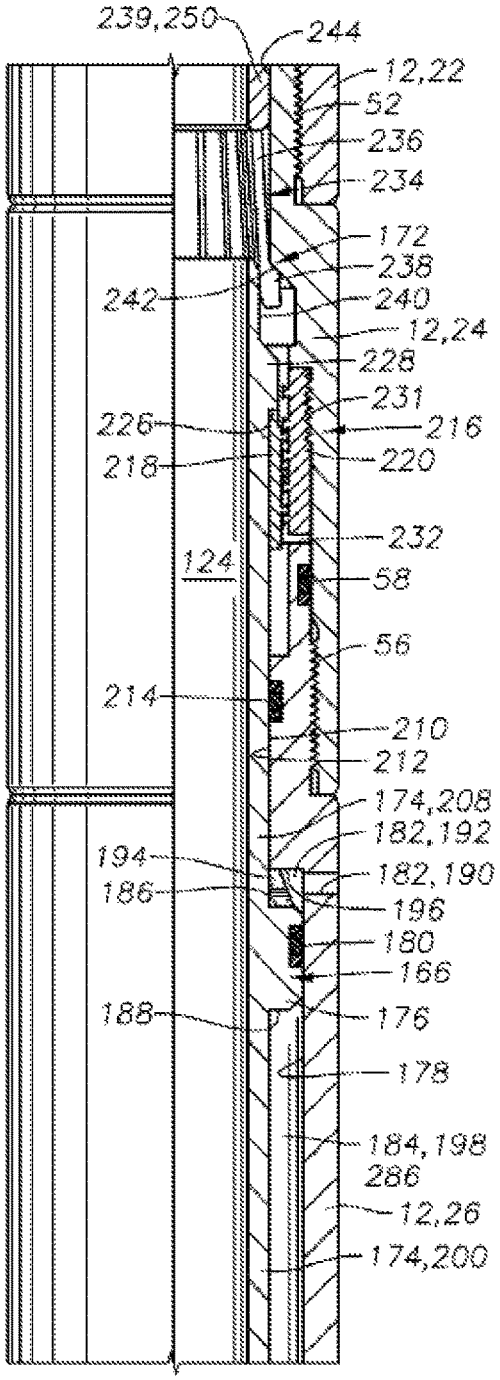

Pressure responsive downhole tool 10 further includes a lower first power piston mechanism 166 seen in FIG. 1D, and an upper second power piston mechanism 168 seen in FIG. 1C. First piston mechanism 166 can generally be described as a hydrostatic referenced annulus pressure responsive first power piston mechanism 166. By hydrostatic referenced, it is meant that the power piston 166 will operate in response to a pressure differential between a hydrostatic well annulus pressure at the depth at which pressure responsive downhole tool 10 is located in the well, and an artificially increased well annulus pressure which is applied to operate tool 10, as will be further described in detail below. Second piston mechanism 168 can generally be described as a lower than hydrostatic referenced annulus pressure responsive second piston mechanism 168. In certain exemplary embodiments, second piston mechanism 168 is referenced to to substantially atmospheric pressure contained in a sealed low pressure chamber 170 seen in FIG. 1C.

A prevention mechanism generally designated by the numeral 172 is operatively associated with the first and second piston mechanism 166 and 168 for preventing the second piston mechanism 168 from moving from its first position as seen in FIGS. 1C-1D to an upper second position, until the first piston mechanism 166 has moved at least part way from its upper first position seen in FIG. 1D to a lower second position relative to housing 12, as will be described in further detail below. Second power piston mechanism 168 can generally be described as being operatively associated with both the safety valve mechanism 82 and circulating valve mechanism 84 of operating element mechanism 86 for permitting operating element mechanism 86 to move from a first position, wherein the safety valve mechanism 82 is open and circulating valve mechanism 84 is closed, to a second position wherein safety valve mechanism 82 is closed and circulating valve mechanism 84 is open in response to movement of second piston mechanism 168 upward from its first position shown in FIG. 1C to an upper second position relative to housing 12.

First power piston mechanism 166 includes an elongated first power mandrel 174 having an enlarged diameter piston 176 defined thereon which is closely slidably received within a bore 178 of lower power housing section 26. A sliding piston seal 180 is received in the enlarged piston 176 and sealingly engages the bore 178. Housing 12 has first and second pressure conducting passage 182 and 184, respectively, disposed therein for communicating a well annulus exterior of housing 12 with a first upper side 186 and a second lower side 188 of the piston 176 of first piston mechanism 166. Upper first side 186 can generally be referred to as a high pressure side, and the lower second side 188 can generally be referred to as a low pressure side of piston 176. First pressure conducting passage mechanism 182 includes a first power port 190 disposed radially through lower power housing section 26, and an annular space 192 defined between first power mandrel 174 and bore 178 above piston 176. First piston mechanism 166 includes a plurality of integrally formed upward extending ridges 194 which abut a downward facing shoulder 196 of lower power housing section 26. Second pressure conducting passage 184 includes an annular space 198 defined between a lower portion 200 of first power mandrel 74 and the bore 178 of lower power housing section 26. Second pressure conducting passage 184 also includes a plurality of longitudinally extending bores 202 disposed through filler housing section 28.

An annular equalizing chamber 204 defined between the inner and outer tubular portions 32 and 34 of equalizing chamber housing section 30 is also included in second pressure conducting passage 184. Longitudinal bores 202 communicate annular space 198 with annular equalizing chamber 204. A lower end of equalizing chamber 204 is communicated with the well annulus by an equalizing port 206 of second pressure conducting passage 184. Lower portion 200 of first power mandrel 174 has a lower end 201 with a cylindrical outer surface 203 closely received within an upper bore 205 of filler housing section 28 with a seal being provided therebetween by O-ring 207. First power mandrel 174 has an upper portion 208 which has a cylindrical outer surface 210 thereof closely slidably received within a bore 212 of lower power housing section 26 with a seal being provided therebetween by O-ring 214.

A threaded shearable retaining mechanism 216 is operably associated with upper power mandrel portion 208 of first piston mechanism 166 for holding first piston mechanism 166 in its first position as seen in FIG. 1D until a pressure differential across piston 176 thereof reaches a predetermined value. Threaded shearable retaining mechanism 216 in the illustrated embodiment is a threaded connection comprising a pin connection 218 and a box connection 220. A downward facing annular shoulder 226 of an enlarged diameter portion 228 of first power mandrel 174 engages the upper end of pin connection 218, while an upper end box connection 220 is threaded to shear thread housing 24 at threaded connection 231 so that a downward load placed upon first piston mechanism 166 will be, in turn, applied across pin connection 218 to shear threaded shearable retaining mechanism 216. A gap 232 is positioned between the lower end of box connection 220 and the upper end of low power housing section 26. As will be further described below, in certain embodiments, pin connection 210 may be sheared, while in other embodiments box connection 220 is sheared. Nevertheless, once sheared, first piston mechanism 166 is allowed to move to a second position whereby further operation of tool 10 is facilitated, as described below.

Prevention mechanism 172 seen in the upper portion of FIG. 1D is, in the embodiment of FIGS. 1A-1F, a releasable mechanical locking mechanism 172 for releasably locking second piston mechanism 168 in its lowermost first position as seen in FIGS. 1C-1D, so long as the first piston mechanism 166 is in its uppermost first position as seen in FIG. 1D. Releasable mechanical locking mechanism 172 includes a spring collet 234 connected to the second piston mechanism 168 and including a plurality of downward extending spring fingers such as 236 each of which has an enlarged lug 238 on the lower end thereof. In the embodiment shown in FIGS. 1C-1D, spring collet 234 is constructed as an integral part of a second power mandrel 239 of second piston mechanism 168.

Housing 12, the first and second piston mechanism 166 and 168, and the spring collet 234 are so arranged and constructed that when the first piston mechanism 166 is in its uppermost first position as seen in FIG. 1D, an upper cylindrical outer surface 240 of first power mandrel 174 engages the spring fingers 236 and holds the lugs 238 thereof in a radially outward position wherein the lugs 238 engage a radially inner downward facing tapered shoulder 242 of shear thread housing section 24. When the first piston mechanism 166 moves downward relative to housing 12, outer surface 240 thereof will move downward out of engagement with the spring fingers 234, thus releasing spring fingers 234 and the lugs 238 thereof so that spring fingers 234 may deflect radially inward to allow the second power mandrel 239 and the spring collet 234 to move upward through a central bore 244 of shear thread housing section 24. An O-ring 246 provides a sliding seal between an outer surface 248 of a lower portion 250 of second power mandrel 239 and bore 244.

Second piston mechanism 168 includes second power mandrel 239 and an enlarged diameter second power piston 252 which is closely received within a bore 254 of upper power housing section 22. A piston seal 256 provides a sliding seal between enlarged diameter piston 252 and bore 254. An upper portion 258 of second power mandrel 239 has a cylindrical outer surface 260 which is closely and slidably received within a reduced diameter bore 262 of upper power housing section 22 with a seal being provided therebetween by sliding O-ring 264. The upper end of second power mandrel 239 is connected to lower seat holder 128 at threaded connection 266 with a seal being provided therebetween by O-ring 268. Upper power housing section 22 has a second power port 270, which may also be generally described as a power passage 270, disposed therethrough which always communicates the well annulus exterior of the housing 12 with a lower high pressure side 272 of piston 252 of second piston mechanism 168.

Second piston mechanism 168 includes a plurality of ridges 274 extending downward from piston 252 to prevent the lower side 272 of piston 252 from abutting the upper end of shear thread housing section 24. Sealed low pressure chamber 170 previously mentioned is defined between outer surface 260 of upper portion 258 of second power mandrel 239 and the bore 254 of upper power housing section 22 between seals 264 and 256. As previously mentioned, low pressure chamber 170 is generally filled with air at substantially atmospheric pressure when pressure responsive downhole tool 10 is assembled at the surface of the earth.

When a downward pressure differential across first piston mechanism 166 is sufficiently large to shear threaded shearable retaining mechanism 218, the first piston mechanism 166 moves downward thus releasing the prevention mechanism 172 and allowing the second piston mechanism 168 to be moved upward by the upward acting pressure differential between the well annulus and the low pressure chamber 170. This pushes the entire safety valve assembly 82 upward relative to housing 12 thus rotating ball valve 116 thereof to a closed position. This upward motion also impacts actuating mandrel 136 with the circulating valve sleeve 88 to shear the shear pins 110 and allow circulating valve sleeve 88 to be moved upward by spring 102 to open circulating port 96.

Figure 1E:
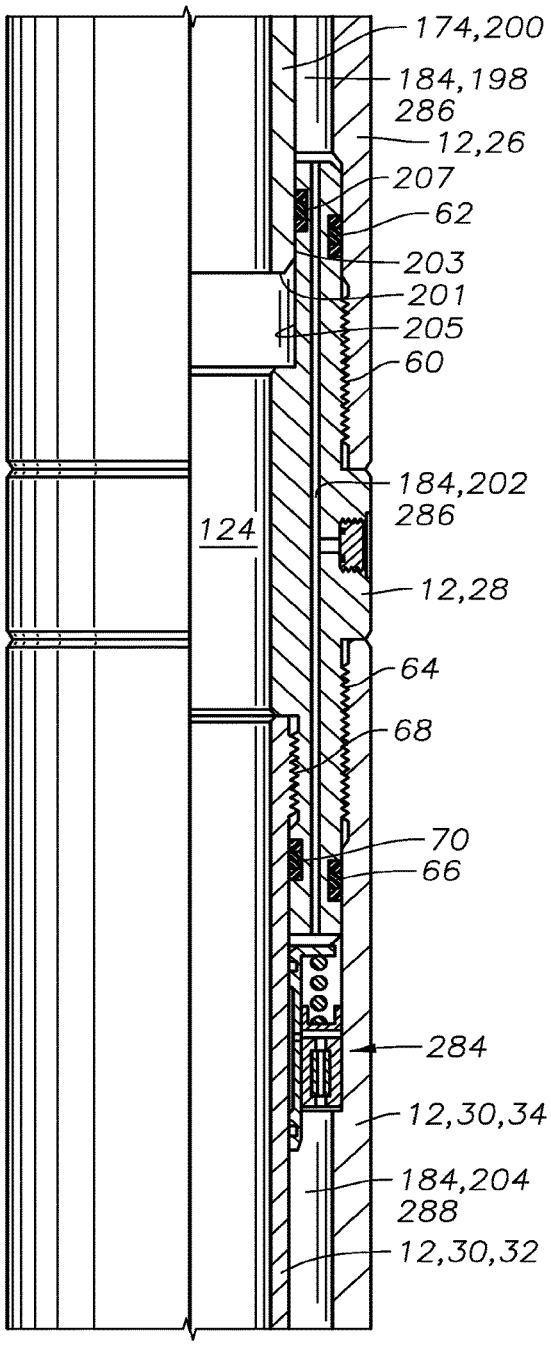

A locking mechanism 276 is operably associated with housing 12 and upper portion 258 of second power mandrel 239 of second piston mechanism 168 for locking the second piston mechanism 168 in its uppermost second position. Locking mechanism 276 includes a plurality of segmented locking dogs 278 biased radially inward by an annular resilient band 280. When second piston mechanism 168 is in its uppermost second position, a radially outer annular groove 282 thereof receives locking dogs 278 therein to lock second piston mechanism 168 in place relative to housing 12. A retarding mechanism generally designated by numeral 284 is disposed in the second pressure conducting passage 184 of housing 12 as seen in the lower portion of FIG. 1E. Retarding mechanism 284 can generally be described as a mechanism for delaying communication of a sufficient portion of a relatively rapid increase in well annulus pressure to the low pressure side 188 of first piston mechanism 166 for a sufficient time to allow a downward pressure differential across first piston mechanism 166 to move the first piston mechanism 166 from its first position as illustrated in FIGS. 1D-1E to a lower second position.

Retarding mechanism 284 can also be generally described as a mechanism for communicating a relatively slow increase in well annulus pressure to low pressure side 188 of first piston mechanism 166 quickly enough that a downward pressure differential across first piston mechanism 166 is too low to move the first piston mechanism 166 from its first position to a lower second position, so that hydrostatic well annulus pressure may be substantially balanced across first piston mechanism 166 as the pressure responsive downhole tool 10 is lowered into a well. As previously described, the downward pressure differential which must be placed across first piston mechanism 166 to move it downward from the first position illustrated in FIGS. 1D-1E is determined by the construction of the releasable retaining mechanism 216, and may be varied as desired as will be understood by those ordinarily skilled in the art having the benefit of this disclosure.

Due to the fact that retarding mechanism 284 allows relatively slow increases in well annulus pressure to be metered through to the lower side 188 of first piston mechanism 166, to thereby balance hydrostatic well annulus pressure across the first piston means 166 as pressure responsive downhole tool 10 is lowered into a well, retarding mechanism 284 can be said to be a mechanism for preventing the threaded shearable retaining mechanism 216 from having any substantial force applied thereacross as a result of increasing hydrostatic well annulus pressure as pressure responsive downhole tool 10 is lowered into a well. Retarding mechanism 284 can generally be described as a metering cartridge 284 which divides second pressure conducting passage 184 into an upper first portion 286 between the lower second side 188 of first piston mechanism 166 and the metering cartridge 284, and a lower second portion 288 between the metering cartridge 284 and the well annulus. The operation of metering cartridge 284 is well known in the art and will not be described further.

In certain exemplary embodiments, metering cartridge 284 can also generally be described as a selectively actuatable one-way check valve mechanism 284 associated with the second pressure conducting passage 184 for preventing flow of fluid from the well annulus to the lower second side 188 of first piston mechanism 166, so that after the check valve 284 is actuated, an increase in well annulus pressure will create a pressure differential from the first side 186 toward the second side 188 of first piston mechanism 166.

Figure 1F:
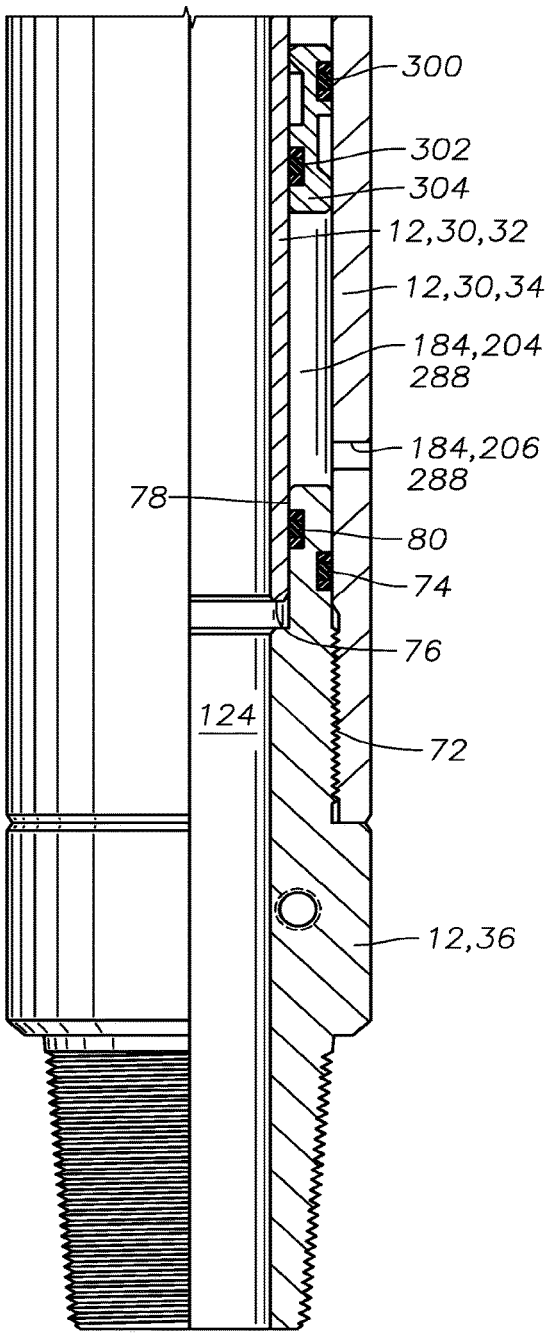

Referring now to FIG. 1F, annular space 204 has a floating piston 304 received therein which has inner and outer seals 302 and 300, respectively, which seal between the floating piston 304 and the inner and outer tubular members 32 and 34, respectively, of equalizing chamber housing section 30. Annular space 204 above floating piston 304 and all those other portions of second pressure conducting passage 184 between floating piston 304 and lower side 188 of first piston mechanism 166 is filled with a liquid, such as, for example, silicone oil. It is this silicone oil which meters through the restricted area flow passage of metering cartridge 284, as understood in the art. Additionally, the slight compressibility of the silicone oil located in the upper first portion 286 of second pressure conducting passage mechanism 184 between the first piston mechanism 166 and metering cartridge 284 provides the necessary decrease in volume of that fluid to allow the first piston mechanism 166 to move downward under its designed operating pressures. Floating piston 304 separates this silicone oil from well fluid which enters equalizing port 206.

Figure 2A:
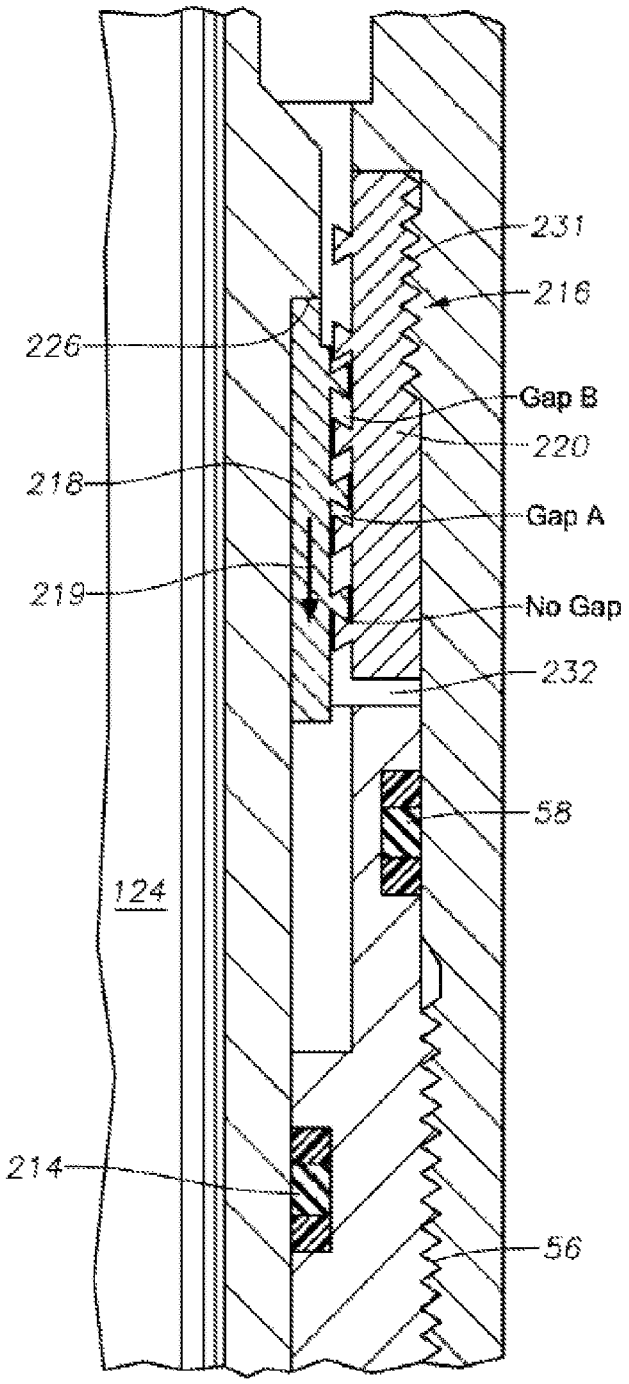
FIG. 2 illustrates an exploded view of a threaded shearable retaining mechanism, in accordance to certain exemplary embodiments of the present invention.

Now referring to the exploded view of threaded shearable retaining mechanism 216 illustrated in FIG. 2A, further operation of the present invention will now be described. In this exemplary embodiment, pin connection 218 is made of a material that is weaker than the material in which box connection 220 is comprised so that pin connection 218 will shear upon application of sufficient pressure. For example, pin connection 218 may be made of brass or a low strength stainless steel, while box connection 220 may be made of high strength low carbon steel or Inconel 718. However, in an alternative embodiment, box threads 220 may be made of the weaker material such that it shears instead of pin connection 218.

In certain exemplary embodiments, the individual threads along pin connection 218 have a constant pitch while the threads along box connection 220 have a variable pitch. As shown in FIG. 2A, the threaded connection formed by pin and box threads 218, 220 comprises a series of mating threads. Along the lower mating threads, there is no gap between the pin and box threads. However, between the adjacent pin and box threads there is a Gap A, and between the next higher adjacent pin and box threads there is a Gap B (which is larger than Gap A). By varying the gap between adjacent mating threads, during operation of such embodiments, the variable pitch thread will load up to the lower mating threads first (threads with no gap). Then, due to compression of pin connection 218 caused by downward pressure 219, Gaps A and B will compress to equally share the load. As a result, all of the threads along pin connection 218 which are engaged by box connection 220 are equally loaded by the pressure 219 being applied across threaded shearable retaining mechanism 218. In addition, pressure 219 also applies a tensile load on box connection 220, which results in stretching of box connection 220 to close gap 232 to facilitate equal loading of the threads of pin connection 218. As will be understood by those ordinarily skilled in the art having the benefit of this disclosure, Finite Element Analysis ("FEA") may be utilized to determine the optimal variable pitch design for box connection 220 in which to achieve equal loading across pin connection 218.

The pressure at which the shearable thread (pin connection 218, for example) will shear, or the shear value, would be determined by the length or degrees of the pin thread that is engaged by box connection 220. For example, in FIG. 2A, all the threads along pin connection 218 have been engaged by box connection 220. Although only three pin threads are illustrated, any number of threads may be utilized as desired. Nevertheless, the more threads that are engaged along pin connection 218, the higher the shear value and pressure necessary to shear threaded shearable retaining mechanism 216. For example, in certain embodiments, if the operator desires to operate at 10,000 lbs, one pin thread may be engaged. If the operator desired to operate at 50,000 lbs, five pin threads may be engaged; if 100,000 lbs is desired, engage 10 threads, and so on. In one embodiment, settings from 1000 lbs (1/10 of a thread engagement 36 degrees) to 100,000 lbs or any infinite variable setting in between may be selected.

Figure 2B:
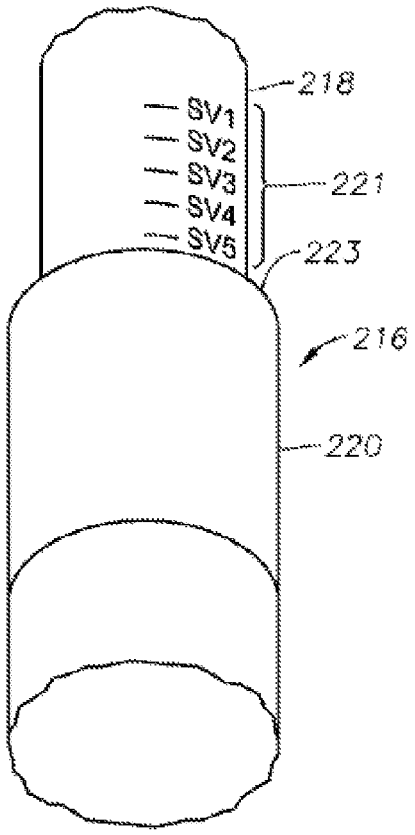

Moreover, in certain embodiments, pin connection 218 includes shear value indicators 221 that indicate the shear value that corresponds to the threads which are engaged along pin connection 218, as shown in FIG. 2B which illustrates a 3D rendering of an exemplary threaded shearable retaining mechanism 216 during assembly. The shear values visible on the exterior of pin connection 218 (similar to a torque wrench, for example) may take the form of, for example, pounds of force. The shearing connection of such an embodiment could also be used in tool designs with different pressure areas or no pressure area all if it was in a tensile operated tool such as a safety joint. In a pressure area tool, however, the pounds of force may be divided by the effective tool area to determine the operating pressure, as understood in the art. Nevertheless, during assembly of pin connection 218 and box connection 220, an operator screws the components together until the upper end 223 of box connection 220 is adjacent the desired shear value indicator 221, which then gives a clear indication of the level of pressure required to shear threaded shearable retaining mechanism 216. Accordingly, tool 10 may be efficiently customized in the field for that particular job.

Operation of tool 10 will be generally described in relation to FIGS. 1A-2A. Tool 10 is first assembled in a well test string and lowered into place within a well, and the packer of the test string is set within the well bore just above the subsurface formation which is to be tested. During assembly, box connection 220 was screwed along pin connection 218 up to the desire shear value indicator 221 such that the desired pressure rating of threaded shearable retaining mechanism 216 is obtained. With the hydrostatically referenced first piston mechanism 166 as utilized in the tool 10, threaded shearable retaining mechanism 216 need only be assembled to withstand the difference between hydrostatic well annulus pressure and the desired operating pressure of the tool 10.

As tool 10 is being lowered into a well, the slowly increasing hydrostatic well annulus pressure corresponding to the increasing depth of the tool 10 within the well can be metered through metering cartridge 284 so that this increased well annulus pressure is substantially balanced across first piston mechanism 166 so that no substantial loading is applied to the threaded shearable retaining mechanism 216. After the tool 10 has been lowered to the desired depth within a well, the packer located therebelow (not shown) in the test string will be set to anchor the test string within the well bore and to seal the well annulus above the subsurface formation being tested. Then, well annulus pressure will typically be increased above hydrostatic well annulus pressure one or more times to operate the tool 10 so that formation fluid may flow upwardly through the test string.

During the time periods in which well annulus pressure has been increased to operate tool 10, the increase in well annulus pressure creates a downward force on the first piston mechanism 166, but the first piston mechanism 166 is retained against movement by threaded shearable retaining mechanism 216 which has been designed to require a higher pressure differential for operation. When it is desired to operate tool 10, well annulus pressure is further increased to the design operating pressure above hydrostatic well annulus pressure. This downward pressure differential across first piston mechanism 166 will applied to pin connection 218, as pressure 219, thus loading the threaded connection between pin and box connections 218, 220. As loading continues, each engaged thread along pin connection 218 is equally loaded as previously described. Once downward pressure 219 becomes greater than the shear value of pin connection 218, each engaged thread shears, thereby releasing first piston mechanism 166 to move downward relative to the housing 12 to a second position. In those embodiments in which a keystone design has been utilized, the shear portions of pin connection 218 will be retained within the mating threads of box connection 220. The design and operation of keystone thread designs will not be described herein, as such technology will be readily understood by those ordinarily skilled in the art having the benefit of this disclosure.

As first piston mechanism 166 moves downward relative to housing 12, the silicone oil in the upper portion 286 of second pressure conducting passage mechanism 184 will be compressed to allow the volume decrease required to accommodate downward movement of the first piston mechanism 166. As first piston mechanism 166 moves downward, the upper end thereof will move out of engagement with spring collet 234, thus allowing spring fingers 236 thereof to be deflected radially inward. That will release second piston mechanism 168, which at that time will have a very large upward pressure differential thereacross. The upward pressure differential across second piston mechanism 168 will be the difference between the increased well annulus pressure and the substantially atmospheric pressure, that is substantially zero psi, in low pressure chamber 170.

This pressure differential acting upwardly across second piston mechanism 168 will move the second piston mechanism 168 upward very rapidly. As previously mentioned, upward movement of second piston mechanism 168 moves ball valve 116 of safety valve mechanism 82 upward relative to housing 12, thus rotating the ball valve 116 to a closed position and closing the flow passage 124 through housing 12. Additionally, this upward movement of second piston mechanism 168 causes the actuating mandrel 136 to impact circulating valve sleeve 88 thus shearing the shear pins 110 holding circulating valve sleeve 88 in its closed position. The spring 102 of circulating valve mechanism 84 then aids in moving the circulating valve sleeve 88 upward to open the circulating port 96, whereby further operations are conducted as understood in the art. Accordingly, through use of threaded shearable retaining mechanism 216, tool 10 provides a safety-circulating valve which may be readily customization for a specific downhole job, thus greatly increasing the flexibility of the tool and alleviating the need for shear sets and/or shear pins and their associated problems.

Figure 3A:
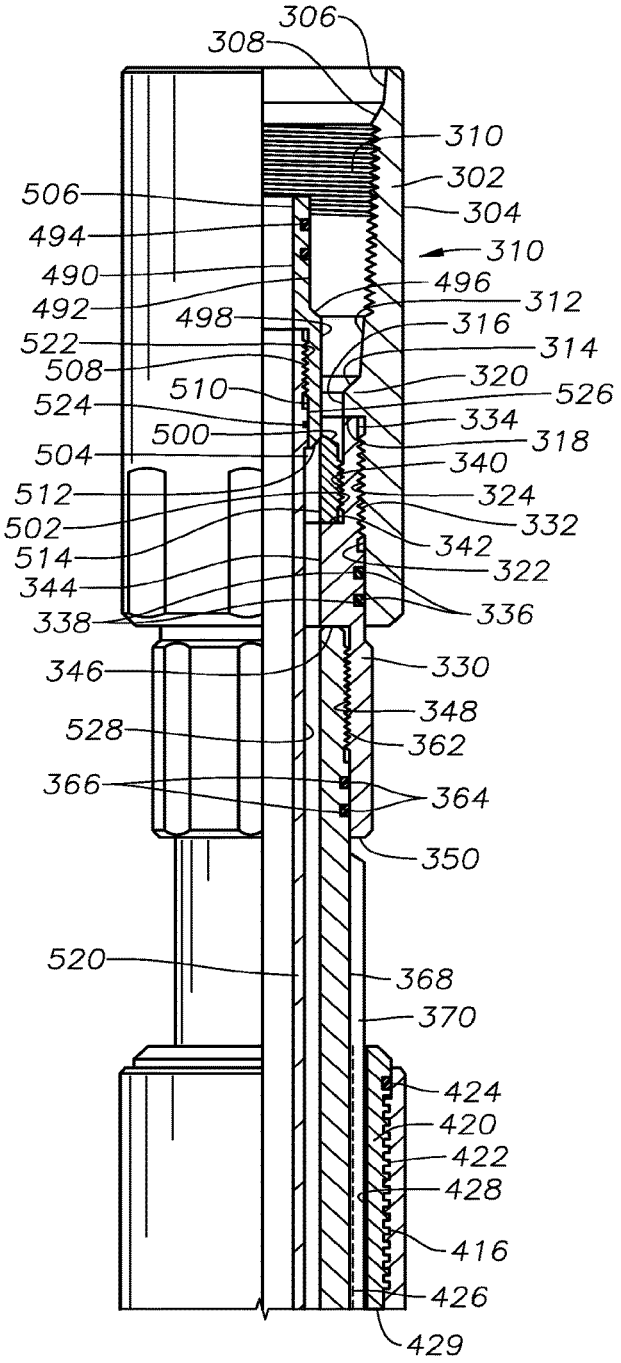
FIGS. 3A-3C are sectional views of a pressure responsive downhole tool (safety joint) having a threaded shearable retaining mechanism in accordance to certain exemplary embodiments of the present invention.
Figure 3B:
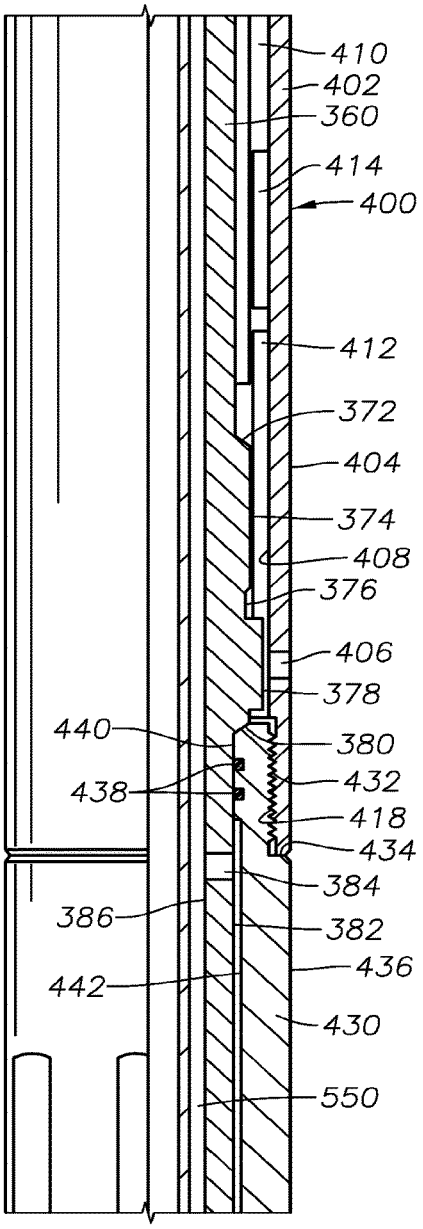
Figure 3C:
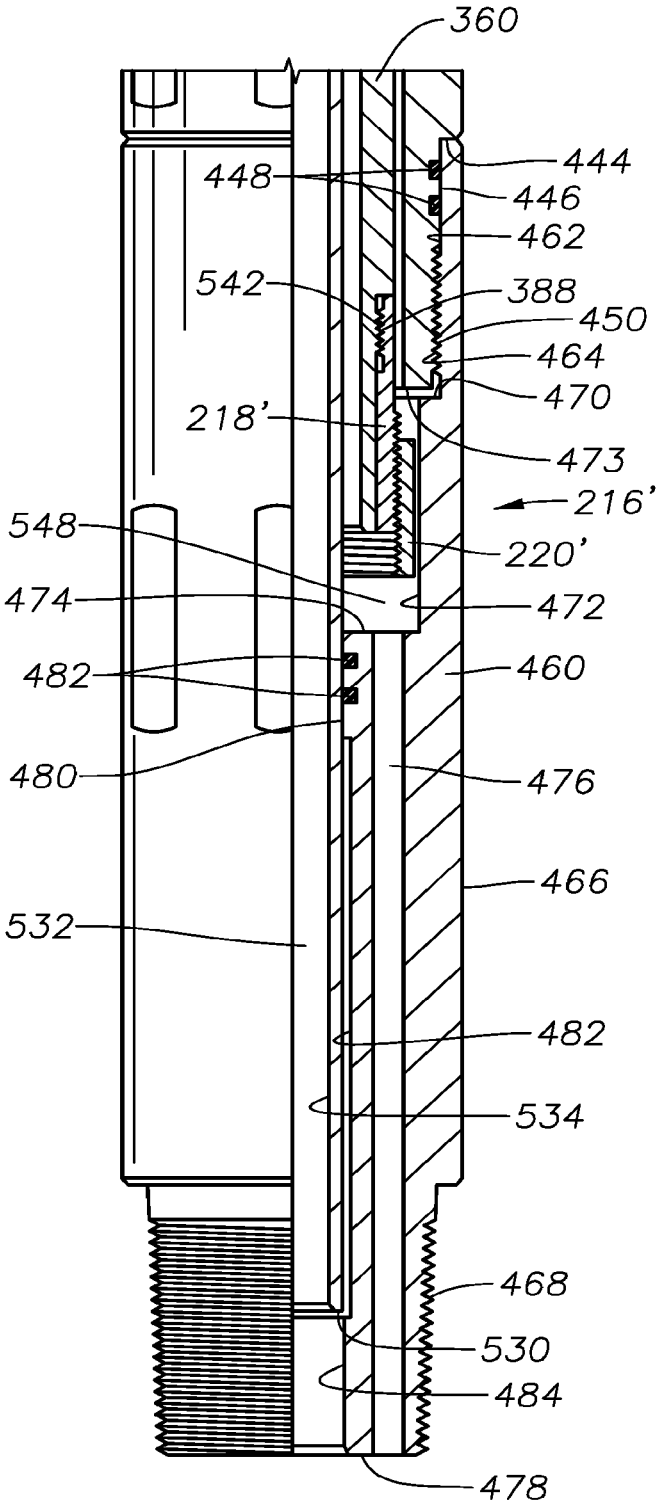

Now referring to FIGS. 3A-3C, an exemplary safety joint is illustrated which utilizes threaded shearable retaining mechanism 216, according to one or more exemplary embodiments of the present invention. Safety joint 310 comprises upper adapter 302 having substantially uniform cylindrical exterior 304 (with flats, unnumbered, at its lower end). The interior of upper adapter 302 comprises entry wall 306, followed by frustoconical surface 308 which leads to box threads 310. Box threads 310 terminate at lower wall 312, which extends to frustoconical surface 314, leading radially inward to cylindrical surface 316, followed by outwardly extending radially flat surface 318. Surfaces 314, 316, and 318 define annular abutment 320 on the interior of upper adapter 302. Cylindrical interior surface 322 having threads 324 thereon leads to the lower end of upper adapter 302.

Mandrel connector 330 possesses threads 332 on its upper exterior surface, which threads 332 engage threads 324 on upper adapter 302, and are made up therewith until upper end 334 of mandrel connector 330 contacts annular abutment 320. Below threads 332, a pair of O-rings 336 in annular grooves 338 in the exterior of mandrel connector 330 provide a fluid-tight seal between upper adapter 302 and mandrel connector 330. The upper interior of mandrel connector 330 has interior threads 340 thereon, followed by radially flat wall 342 leading inwardly to cylindrical interior surface 344, which extends to radially flat wall 346 leading outwardly to threaded surface 348, which extends to the lower end of mandrel connector 330. The lower end of mandrel connector 330 comprises radially flat annular surface 350.

Mandrel 360 is secured to threads 348 of mandrel connector 330 by threads 362. Below threads 362, a pair of O-rings 364 in annular grooves 366 provide a fluid-tight seal between mandrel connector 330 and mandrel 360. Below annular grooves 366, the exterior of mandrel 360 comprises upper cylindrical surface 368 from which spline 370 extends radially outward. Below the end of spline 370, tapered annular surface 372 leads outwardly to cylindrical plateau 374, which extends to recessed area 376 from which J-slot lug 378 protrudes above cylindrical plateau. Spline 370 and J-slot lug 378 are substantially circumferentially aligned. Below plateau 374, tapered annular surface 380 leads inwardly to lower cylindrical surface 382, which is pierced by a plurality of inner relief ports 384 which extend through the wall of mandrel 360 to substantially cylindrical inner surface 386. Mandrel 360 terminates on its exterior at lower end with an annular stop leading to thread 388, the diameter of thread 388 being less than that of lower cylindrical surface 382.

Housing 400 surrounds mandrel 360 and comprises at its top end case 402 having substantially uniform cylindrical exterior 404, with a plurality of outer relief ports 406 extending through the wall thereof to substantially uniform cylindrical bore wall 408. A plurality of J-slot islands 410 and 412 protrude inwardly from bore wall 408 around its inner circumference, defining automatic J-slot 414. One exemplary embodiment possesses two substantially identical islands 410 and two substantially identical islands 412. Above J-slot 414 on the interior of case 402, left-hand threads 416 are cut into bore wall 408. Below J-slot 414, standard right-hand threads 418 are cut into bore wall 408.

Tubular mandrel retainer nut 420 having left-hand threads 422 on the exterior thereof is shown threaded into case 400. O-ring 424 provides an initial seal between case 400 and nut 420 to prevent grit and debris-laden well fluids from hindering the initial back-off of nut 420 during operation of the safety joint. Nut 420 possesses a cylindrical bore defined by bore wall 426, onto which longitudinally oriented keyway 428 opens throughout the entire length of nut 420. The lower end of nut 420 is defined by radially flat annular wall 429.

Connector 430 is secured to threads 418 of case 402 by threads 432. Case 402 is made up to connector 430 until the former's lower end abuts annular shoulder 434 on the latter.

The exterior of connector 430 comprises substantially cylindrical surface 436 (having flats thereon) of substantially the same diameter as surface 404. A fluid-tight seal is achieved between connector 430 and lower cylindrical surface 382 of mandrel 360 by O-rings 438 disposed in annular grooves (unnumbered) in the interior of connector 430. Below O-ring seal surface 440, the inner diameter of connector 430 increases in a short step to bore wall 442, which extends to the lower end of connector 430. At the lower outer extent of connector 430, radially flat annular shoulder 444 drops inwardly to seal surface 446, which possesses annular grooves therein containing O-rings 448. Below seal surface 446, exterior threads 450 lead to the end of connector 430.

O-rings 448 achieve a fluid-tight seal between seal surface 446 and undercut surface 462 of lower adapter 460, interior threads 464 mating with exterior threads 450 on connector 430. The exterior of lower adapter 460 comprises a cylindrical surface 466 of substantially the same diameter as surfaces 404 and 436; the lower exterior end of lower adapter 460 comprises pin thread 468. Below threads 464, radially flat annular shoulder 470 abuts against connector 430 and leads inwardly to threaded retaining mechanism bore wall 472, which in turn is terminated at annular radially flat passage wall 474, which is pierced by a plurality of longitudinal packer fluid bores 476 leading to the bottom end 478 of lower adapter 460. In turn, the lower end of connector 430 extends out beyond threaded retaining mechanism bore wall 472, thus forming an abutting shoulder 473. Immediately below passage wall 474 on the interior of lower adapter 460, lies mandrel seal surface 480 having grooves cut therein, in which O-rings 482 are disposed. Below mandrel seal surface 480, the bore of lower adapter 460 increases slightly at bore wall 482, which extends to a short annular step proximate the end of lower adapter 460, where the bore is narrowed again at end bore wall 484.

Referring again to the top end of safety joint 310 and in particular FIG. 3A, seal mandrel 490 possesses exterior cylindrical seal surface 492 with O-ring seals 494 therein at its top end. First tapered annular edge 496 leads outwardly to intermediate surface 498, also of cylindrical configuration. Second tapered annular edge 500 leads outwardly to threaded cylindrical surface 502, which is secured to threads 340 of mandrel connector 330, the lower end of seal mandrel 490 abutting wall 342. A plurality of oblique packer fluid passages 504 extend through second tapered edge 500 to the interior of seal mandrel 490. The interior of seal mandrel 490 comprises cylindrical upper bore wall 506 at its top end, terminating in a radially flat annular face extending outwardly to threaded interior surface 508 having smooth mandrel seal surface 510 therebelow. Below mandrel seal surface 510, annular wall 512 extends radially outwardly to cylindrical bore wall 514. Oblique packer fluid passages 504 pierce wall 512.

Flow tube 520 extends substantially from seal mandrel 490 to end bore wall 484 of lower adapter 960. Flow tube 520 is secured to threaded surface 508 of seal mandrel 490 by threads 522. O-ring seal 524 in an annular groove on the exterior of flow tube 520 creates a fluid-tight seal between seal surface 526 of flow tube 520 and mandrel seal surface 510 on seal mandrel 490. A slight inwardly annular tapered edge leads from seal surface 526 to smooth cylindrical flow tube surface 528, which extends substantially to the lower end 530 of flow tube 520. The interior bore 532 of flow tube 520 is substantially uniform and defined by bore wall 534. A substantially fluid-tight seal is achieved between lower adapter 460 and flow tube 520 by seals 482. Annular packer fluid passage 550 is defined by the interior of mandrel 360 and the exterior of flow tube 520.

Now referring to FIG. 3C, a threaded shearable retaining mechanism 216' is coupled to the lower end of mandrel 360. As described in relation to the other embodiments herein, threaded shearable retaining mechanism 216' comprises pin connection 218' and mating box connection 220'. Pin connection 218' has interior threads 542 at its top end, which threads engage threads 388 on mandrel 360. Box connection 220' is coupled to pin connection 218' along the threaded connections formed between the two, as previously described. Box connection 220' is otherwise free to slidingly move along threaded retaining mechanism bore wall 472. When safety joint 310 is assembled, box connection 220' is screwed onto pin connection 218' until the desired number of threads along pin connection 218' have been engaged, thereby providing the predetermined shear value necessary for the specific job. Although not shown, certain embodiments of threaded shearable retaining mechanism 216' may also comprise the shear value indicators. The interior of pin connection 218' and the exterior of flow tube 520 define annular packer fluid passage 548. In certain exemplary embodiments, all of the metallic components of the safety joint 310 are normally made of steel, including threaded shearable retaining mechanism 216', which has a predetermined shear strength as previously described to ensure parting of the threaded connection at a predetermined upward force on the workstring.

Referring now to FIGS. 3A-3C, this exemplary embodiment of safety joint 310 is operated by the reciprocation and right-hand rotation of the workstring. Assuming for the purposes of illustration that the portion of the workstring (well testing assembly, for example) below safety joint 310 is stuck in the well bore, either due to non-deflation of the packers (not shown) or for another reason, the operator sets down the workstring and applies right-hand torque to the workstring, which applies a right-hand rotational force to mandrel 360, which is keyed to nut 420 by spline 370 in keyway 428. This force causes nut 420 (which is left-hand threaded) to back off from case 402, permitting J-slot lug 378 to move 90° circumferentially in J-slot 414.

The operator then lifts up on the workstring with the derrick to create sufficient tension to shear threaded shearable retaining mechanism 216' along the threaded connection formed between pin and box connections 218', 220'. To achieve this, the upward force along the tool causes mandrel 360 and threaded shearable retaining mechanism 216' to move upwardly, eventually causing the upper end of box connection 220' to shoulder out against shoulder 473. Continued upward force eventually exceeds the shear value of the threaded connection, thus resulting in shearing of the pin connection 218' or box connection 220'. In one exemplary embodiment, pin connection 218' shears, while in others box connection 220' may shear. In addition, those embodiments utilizing a keystone design will retain the sheared thread along the threaded connection, as understood in the art.

The shearing of threaded shearable retaining mechanism 216' permits mandrel 360 and flow tube 520 to move upward with respect to housing 400. This upward movement is ultimately limited by contact of mandrel surface 372 with the lower end of nut 420. However, prior to contacting wall 429, J-slot lug 378 encounters an island 410 defining J-slot 414, which exerts a right-hand rotational force on J-slot lug 378. The operator then sets down weight on the workstring, causing mandrel 360 and flow tube 520 to telescope back into housing 400. The sequence of setting down, followed by right-hand rotation, then picking up the workstring, is repeated until flow tube 520 pulled free, allowing workstring to be withdrawn from the well bore, as will be understood by those ordinarily skilled in the art having the benefit of this disclosure. In certain alternative embodiments, it should be noted that the shearing of threaded shearable retaining mechanism 216' may be all that is necessary to release the workstring, the entire downhole pump assembly and related components from the well bore.

Although not illustrated, the threaded shearable retaining mechanism of the present invention described herein may also be utilized in a Below Packer Hydraulic Safety Joint commercially offered through Halliburton Energy Services, Co. of Houston, Tex., and described in co-pending Patent Cooperation Treaty Application No. PCT/US2012/048029, entitled "TIME DELAYED SECONDARY RETENTION MECHANISM FOR SAFETY JOINT IN A WELLBORE," filed Jul. 25, 2012, the disclosure of which is hereby incorporated by reference in its entirety. In such an exemplary safety joint, the primary and secondary retaining mechanisms (shear pin sets) will be replaced by the threaded shearable retaining mechanism of the present invention, as will be understood by those ordinarily skilled in the art having the benefit of this disclosure.

Accordingly, through use of the present invention, the operation of pressure responsive tool which require tension sleeves or shear sets is greatly improved for a number of reasons. First, for example, the threaded shearable retaining mechanism is infinitely adjustable by varying the length of the thread engagement. As such, each tool may be more specifically customized for a given job. Second, the shear value of the threaded shearable retaining mechanism is readily ascertainable using the shear value indicators. Third, through use of the keystone design, the sheared threads would be retained by the mating thread connection and not lost in the well. Fourth, verification that the tool is set correctly is made more efficient, and the time required to assembled the conventional shear sets is alleviated.

An exemplary embodiment of the present invention provides a pressure responsive downhole tool, comprising a tool housing having a first body and a second body operably connected to each other and a threaded shearable retaining mechanism connecting the first and second bodies to each other in a first position, the threaded shearable retaining mechanism being adapted to shear upon application of sufficient pressure, the threaded shearable retaining mechanism comprising a threaded pin connection; and a threaded box connection that mates with the threaded pin connection, thereby forming a threaded connection along the threaded shearable retaining mechanism, wherein shearing of the threaded connected allows the first or second body to move to a second position in relation to each other. In an alternative embodiment, the tool is a safety valve and movement to the second position facilitates further operation of the safety valve. Yet another further comprises a power piston slidably disposed within the tool housing for applying the pressure to the threaded shearable retaining mechanism.

In another exemplary embodiment, the tool is a safety joint forming part of a workstring, the safety joint releasing a portion of the workstring once the first or second body has moved to the second position. In another, the threaded pin connection is comprised of a weaker material than the threaded box connection such that the threaded pin connection is sheared when sufficient pressure is applied. In yet another, the threaded box connection is comprised of a weaker material than the threaded pin connection such that the threaded box connection is sheared when sufficient pressure is applied. In another, the threaded pin connection comprises a constant pitch and the threaded box connection comprises a variable pitch. In yet another, those threads along the threaded pin connection which are engaged by the threaded box connection are equally loaded during application of sufficient pressure. In another, the threaded connection comprises a keystone design. Yet another embodiment further comprises indicators along the threaded pin connection to indicate a shear value of each thread along the threaded pin connection.

An exemplary methodology of the present invention provides a method of using a pressure responsive downhole tool, the method comprising positioning the tool along a desired location of a well, the tool comprising: a tool housing having a first body and a second body operably connected to each other; and a threaded shearable retaining mechanism connecting the first and second bodies to each other in a first position, the threaded shearable retaining mechanism comprising: a threaded pin connection; and a threaded box connection that mates with the threaded pin connection to form a threaded connection; applying pressure to the threaded shearable retaining mechanism; shearing the threaded connection, thereby allowing movement of the first or second body; and moving the first or second body to a second position in relation to each other. In another methodology, the tool is a safety valve and movement to the second position facilitates further operation of the safety valve. In yet another, applying pressure to the threaded shearable retaining mechanism further comprises utilizing a power piston slidably disposed within the tool housing for applying the pressure.

In another methodology, the tool is a safety joint forming part of a workstring, the safety joint releasing a portion of the workstring once the first or second body has moved to the second position. In another method, the threaded pin connection is comprised of a weaker material than the threaded box connection such that the threaded pin connection is sheared when pressure is applied. In yet another, the threaded box connection is comprised of a weaker material than the threaded pin connection such that the threaded box connection is sheared when pressure is applied. In another, the threaded pin connection comprises a constant pitch and the threaded box connection comprises a variable pitch. In yet another, applying pressure to the threaded shearable retaining mechanism further comprises equally loading those threads along the threaded pin connection which are engaged by the threaded box connection. In another, shearing the threaded connection further comprises utilizing a keystone design along the threaded connected to retain those threads that are sheared within the threaded shearable retaining mechanism. In yet another, the method further comprises positioning indicators along the threaded pin connection to indicate a shear value of each thread along the threaded pin connection.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the invention is not limited to such embodiments and methodologies and will be understood to include all modifications and variations as would be apparent to one skilled in the art. For example, in addition to the tools described herein, the present inventive threaded shearable retaining mechanism may be utilized in a variety of other tools, including, for example, the RTTS® Safety Joint commercially offered through Halliburton Energy Services, Co. of Houston, Tex. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A pressure responsive downhole tool, comprising:

a tool housing having a first body and a second body operably connected to each other;

a threaded shearable retaining mechanism connecting the first and second bodies to each other in a first position; and a piston mechanism releasably locked in a lowermost first position by a releasable mechanical locking mechanism while the first and second bodies are in the first position;

wherein the threaded shearable retaining mechanism is adapted to shear upon application of sufficient pressure, the threaded shearable retaining mechanism comprising:

a threaded pin connection; and a threaded box connection that mates with the threaded pin connection, thereby forming a threaded connection along the threaded shearable retaining mechanism, wherein shearing of the threaded connected allows the first or second body to move to a second position in relation to each other.

2. A tool as defined in claim 1, wherein the tool is a safety valve and movement to the second position facilitates further operation of the safety valve.

3. A tool as defined in claim 2, further comprising a power piston slidably disposed within the tool housing for applying the pressure to the threaded shearable retaining mechanism.

4. A tool as defined in claim 1, wherein the tool is a safety joint forming part of a workstring, the safety joint releasing a portion of the workstring once the first or second body has moved to the second position.

5. A tool as defined in claim 1, wherein the threaded pin connection is comprised of a weaker material than the threaded box connection such that the threaded pin connection is sheared when sufficient pressure is applied.

6. A tool as defined in claim 1, wherein the threaded box connection is comprised of a weaker material than the threaded pin connection such that the threaded box connection is sheared when sufficient pressure is applied.

7. A tool as defined in claim 1, wherein the threaded pin connection comprises a constant pitch and the threaded box connection comprises a variable pitch.

8. A tool as defined in claim 1, wherein those threads along the threaded pin connection which are engaged by the threaded box connection are equally loaded during application of sufficient pressure.

9. A tool as defined in claim 1, wherein the threaded connection comprises a keystone design.

10. A tool as defined in claim 1, further comprising indicators along the threaded pin connection to indicate a shear value of each thread along the threaded pin connection.

11. A method of using a pressure responsive downhole tool, the method comprising:

positioning the tool along a desired location of a well, the tool comprising:

a tool housing having a first body and a second body operably connected to each other;

a threaded shearable retaining mechanism connecting the first and second bodies to each other in a first position, the threaded shearable retaining mechanism comprising:

a threaded pin connection; and a threaded box connection that mates with the threaded pin connection to form a threaded connection; and a piston mechanism releasably locked in a lowermost first position by a releasable mechanical locking mechanism while the first and second bodies are in the first position;

applying pressure to the threaded shearable retaining mechanism;

shearing the threaded connection, thereby allowing movement of the first or second body; and moving the first or second body to a second position in relation to each other.

12. A method as defined in claim 11, wherein the tool is a safety valve and movement to the second position facilitates further operation of the safety valve.

13. A method as defined in claim 12, wherein applying pressure to the threaded shearable retaining mechanism further comprises utilizing a power piston slidably disposed within the tool housing for applying the pressure.

14. A method as defined in claim 11, wherein the tool is a safety joint forming part of a workstring, the safety joint releasing a portion of the workstring once the first or second body has moved to the second position.

15. A method as defined in claim 11, wherein the threaded pin connection is comprised of a weaker material than the threaded box connection such that the threaded pin connection is sheared when pressure is applied.

16. A method as defined in claim 11, wherein the threaded box connection is comprised of a weaker material than the threaded pin connection such that the threaded box connection is sheared when pressure is applied.

17. A method as defined in claim 11, wherein the threaded pin connection comprises a constant pitch and the threaded box connection comprises a variable pitch.

18. A method as defined in claim 11, wherein applying pressure to the threaded shearable retaining mechanism further comprises equally loading those threads along the threaded pin connection which are engaged by the threaded box connection.

19. A method as defined in claim 11, wherein shearing the threaded connection further comprises utilizing a keystone design along the threaded connected to retain those threads that are sheared within the threaded shearable retaining mechanism.

20. A method as defined in claim 11, further comprising positioning indicators along the threaded pin connection to indicate a shear value of each thread along the threaded pin connection.

* * * * *